United States Patent [19]

Foy

[11] Patent Number: 4,591,065

[45] Date of Patent: May 27, 1986

[54] FOLDABLE CONTAINER ASSEMBLY

[76] Inventor: Dennis M. Foy, 475 Bonnie Brier, Birmingham, Mich. 48009

[21] Appl. No.: 654,314

[22] Filed: Sep. 25, 1984

[51] Int. Cl.[4] ..... B65D 6/18; B65D 6/26; B65D 21/02

[52] U.S. Cl. ..... 220/7; 206/509; 206/511; 206/512; 220/6

[58] Field of Search ..... 220/6, 7; 206/509, 511, 206/512

[56] References Cited

U.S. PATENT DOCUMENTS

| | | | |
|---|---|---|---|
| 2,457,841 | 1/1949 | Smith | 206/511 |
| 3,283,915 | 11/1968 | Maslow | 206/509 |
| 3,371,816 | 3/1968 | Ricci | 206/511 |
| 3,628,683 | 12/1971 | Frederich | 220/6 |
| 3,680,735 | 8/1972 | Lucas | 206/511 |
| 4,044,910 | 8/1977 | Box | 220/6 |
| 4,062,467 | 12/1977 | Frederich | 220/7 |
| 4,081,099 | 3/1978 | Shead | 220/6 |
| 4,300,695 | 11/1981 | Hsu | 220/6 |
| 4,366,905 | 1/1983 | Forshee | 206/512 |

FOREIGN PATENT DOCUMENTS

| | | | |
|---|---|---|---|
| 1040163 | 10/1953 | France | 220/6 |
| 1365477 | 5/1964 | France | 206/512 |
| 2272907 | 12/1975 | France | 220/7 |
| 974538 | 11/1964 | United Kingdom | 220/7 |
| 734084 | 5/1980 | U.S.S.R. | 206/511 |

*Primary Examiner*—George E. Lowrance

*Attorney, Agent, or Firm*—Reising, Ethington, Barnard, Perry & Milton

[57] ABSTRACT

A foldable container assembly (10) comprises a base (12) having a plurality of sides, at least one side wall (14, 16, 18, 20) extending vertically upwardly from each side of the base (12) with the tops (22) of the side walls all being aligned in a horizontal plane. The invention is characterized by hinges (24) interconnecting each of the side walls to the base with the hinge for a first wall (14) being in a vertically spaced horizontal plane from the hinge for a second side wall (16) for folding the first (14) and second (16) side walls over the base (12) and into overlapping vertical relationship to one another. Hinges (24) on the first and second walls (14, 16) have an associated link (50) having slots (52) therein for allowing the side wall to move vertically relative to the base (12) for locking and unlocking the walls from one another. Two opposing side walls (14, 16) have lugs (32) along opposite edges thereof and an independent channel member (42), affixed to the opposite edges of each of two other opposing side walls (18, 20), has lug-receiving openings (38) and lug-retaining pockets (40) therein for movement of the lugs (32) into the lug-receiving openings (38) and vertically downward into the lug-retaining pockets (40) to interlock the side wall (14, 16) with an adjacent side wall (18, 20). Fork-lift channels (70) allow either full or empty containers (10) to be mechanically lifted for stacking while legs (60), projections (62) and alignment pegs (70) coact with complementary steps (68) and recesses (92) to relatively position and stack the containers (10).

21 Claims, 9 Drawing Figures

FOLDABLE CONTAINER ASSEMBLY

TECHNICAL FIELD

The invention relates to containers of the type used for packaging and shipping goods in bulk, such as automotive parts and the like. More specifically, the invention relates to containers which are collapsible after they have been used in shipping in order to reduce the space required for them to be shipped back to their point of origination by stacking the empty compacted containers.

BACKGROUND ART

Durable collapsible or foldable container assemblies have long been sought after by the shipping and packaging industries as a whole. Packaging and shipping of goods, such as loose, heavy automotive parts, has required the use of disposable cartons which must be knocked down, disassembled and often discarded following only one use. Moreover, use of cardboard boxes or other cartons requires that they be stacked upon scaffolds or pallets, usually of wood, in order to facilitate their loading and unloading via fork-lift trucks. This typically necessitates metal straps or other securing means for keeping the boxes situated upon the pallets, including sheets of plastic material to protect the entire shipping package from the elements.

Another material handling technique for loose parts is using wire cages having sides foldable outwardly or downwardly and secured at the corners thereof by hooks, metal posts or the like; however, the metal posts are not foldable downward, nor can the assembly be easily compacted into a shipping pallet once used. These wire mesh cage assemblies, although stackable on top of one another via the metal corner posts, are quite heavy due to the weighty metal base required for strength. Conversely, where the metal posts were not used, the foldable sides did not of themselves withstand sufficiently the outward load exerted when the container was full.

Industry has used a plastic stackable pallet, which is molded especially to carry a particular part, for example, carburetors for certain automobiles. Parts are placed among an array of specially formed indentations in a pallet which is then stacked upon a similiarly loaded pallet having cooperating recesses and projections therefor. Of course, these types of containers did not have sides.

Heretofore, there has not been a satisfactory foldable container assembly formed of lightweight durable material which may be loaded and stacked upon a similar container and then folded into a compact pallet for storage or shipping while empty.

STATEMENT OF INVENTION AND ADVANTAGES

According to the subject invention there is provided a foldable container assembly comprising a base having a plurality of sides, at least one side wall extending vertically upwardly from each side of said base with the tops of said side walls all being aligned in a horizontal plane. The invention is characterized by hinge means interconnecting each of said side walls to said base with the hinge means for a first side wall being in a vertically spaced horizontal plane from the hinge means for a second side wall for folding said first and second walls over said base and into overlapping vertically spaced relationship to one another.

The molded plastic containers may be compactly stacked upon one another in either the folded (empty) or unfolded vertical (filled) position due to a series of complementary projections and recesses which position the containers in vertically spaced relationship.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
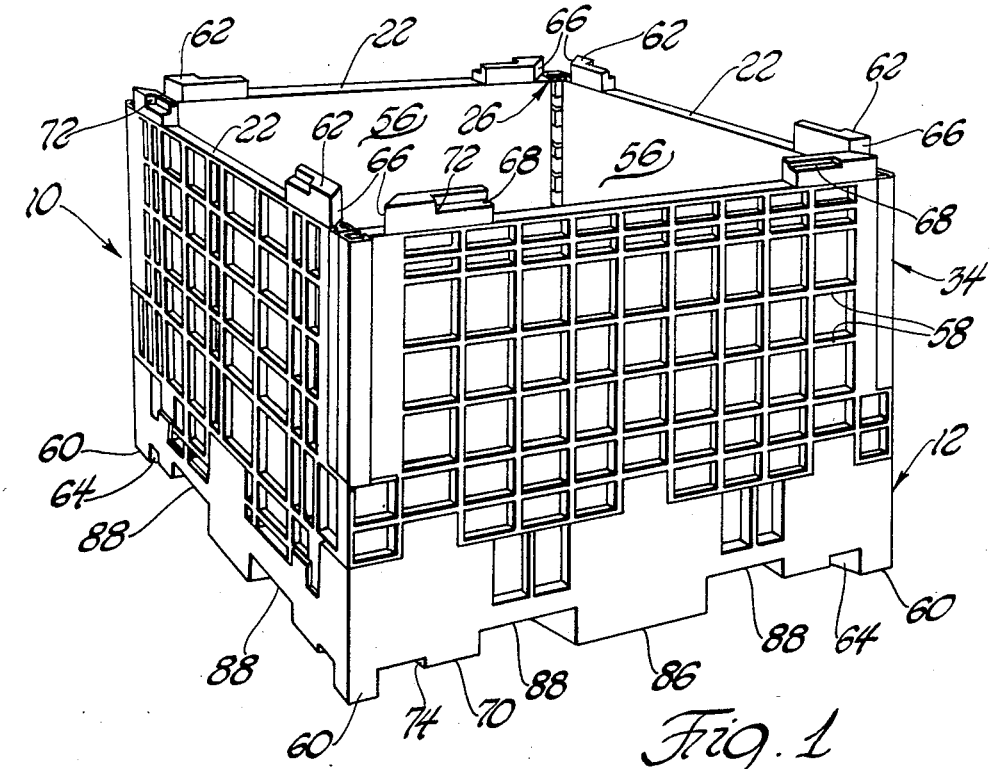
FIG. 1 is a perspective view of the container with the walls in a vertically interlocked position.
Figure 2:
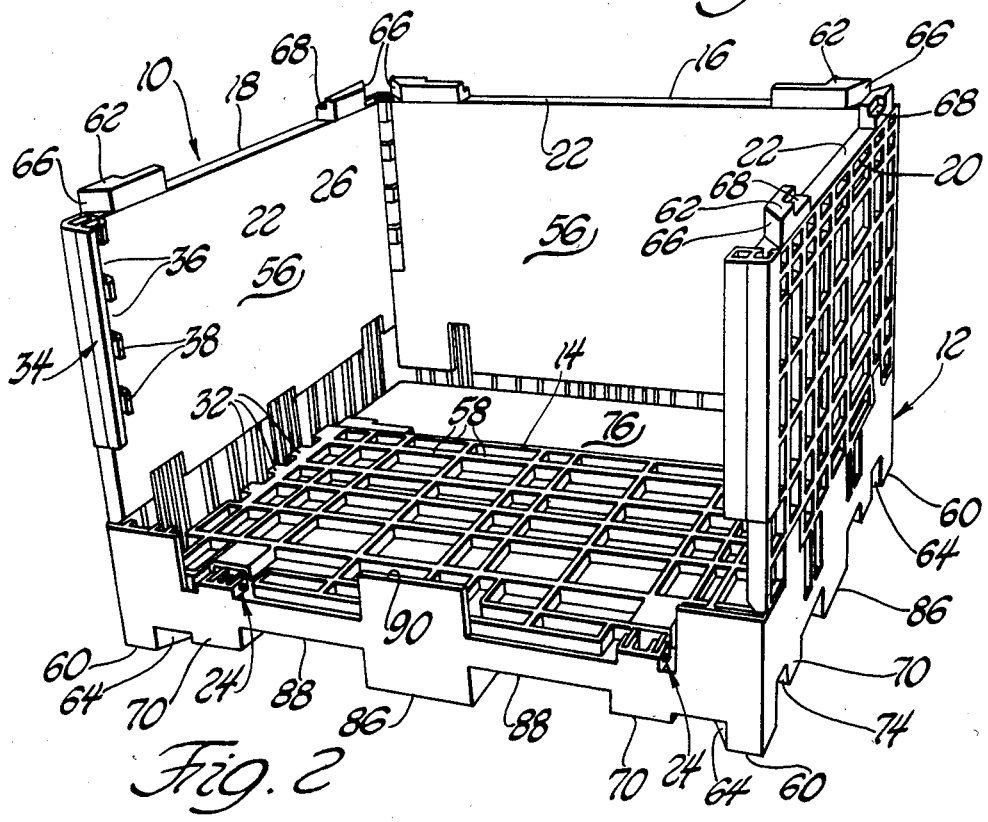
FIG. 2 is a perspective view wherein the first wall has been unlocked disengaged and folded down onto the base.
Figure 3:
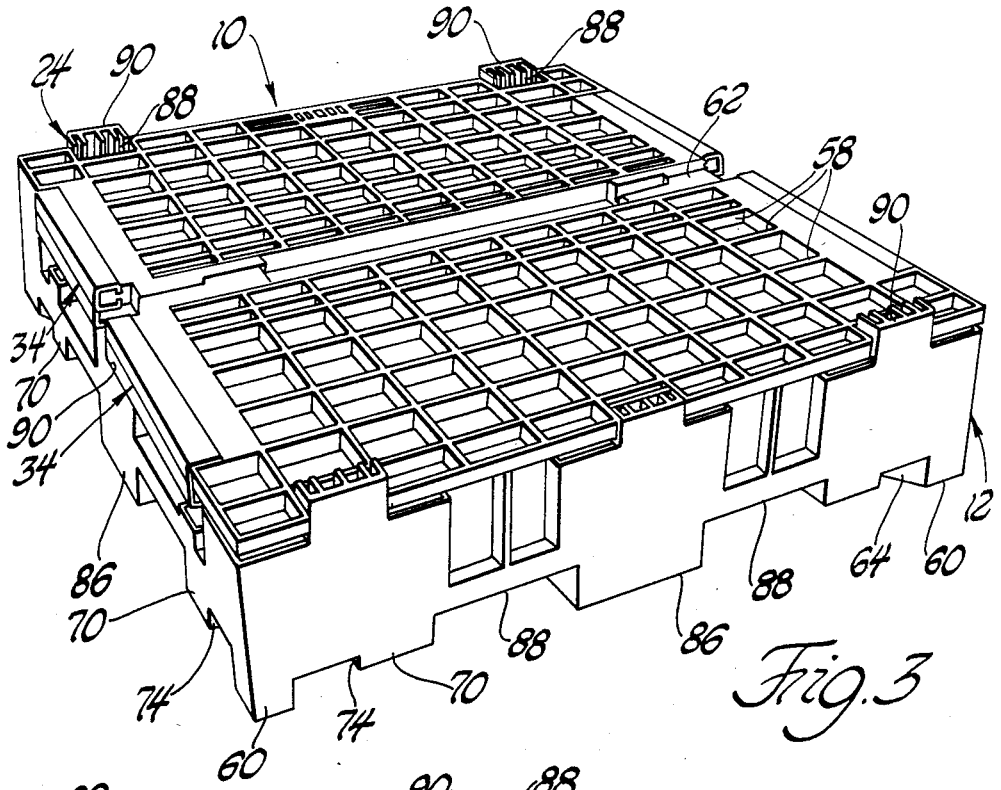
FIG. 3 is a perspective view of the folded container taken from substantially the same angle as FIG. 2.
Figure 4:
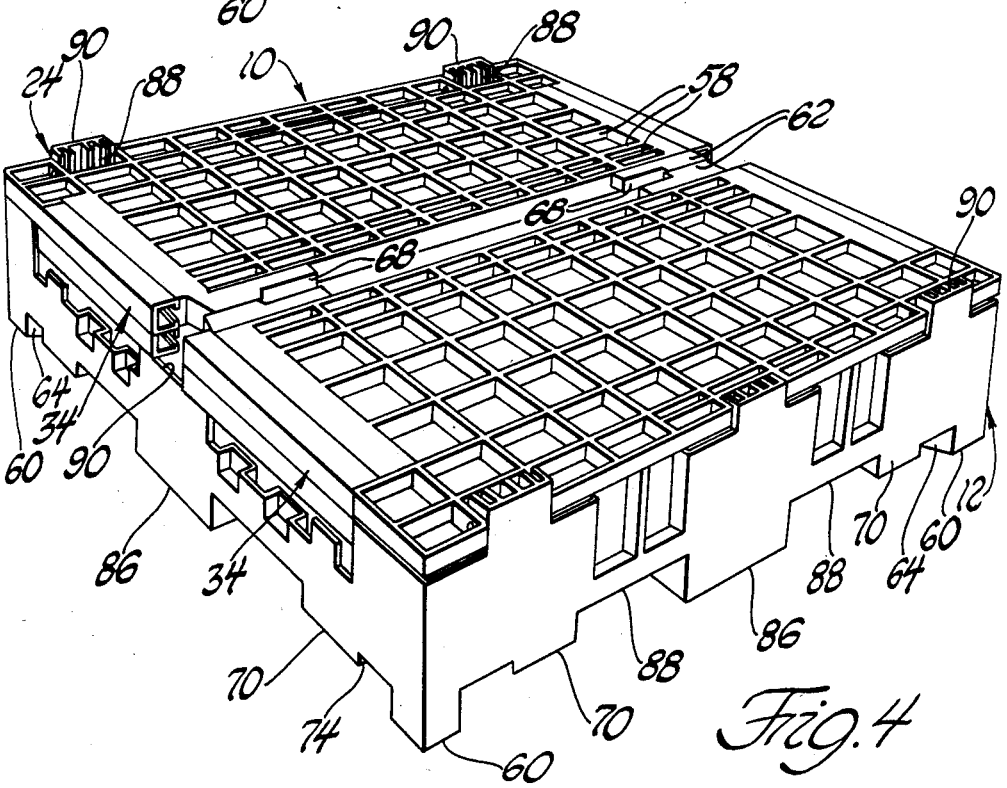
FIG. 4 is a perspective view of the folded container taken generally from the reverse angle of FIG. 3.

A foldable or collapsible container assembly of the subject construction is generally shown at 10 and comprises a base, generally indicated at 12, having a plurality of sides 14, 16, 18, 20 with at least one side wall 14, 16, 18, 20 extending vertically upwardly from each side of the base 12. The tops 22 of the side walls 14, 16, 18, 20 are all aligned in a horizontal plane as shown in FIG. 1. The invention is characterized by hinge means, generally indicated at 24, interconnecting each of the side walls 14, 16, 18, 20 to the base 12 with the hinge means 24 for a first side wall 14, shown in FIG. 2, being in a vertically spaced horizontal plane from the hinge means for a second side wall 16 (FIG. 2) for folding the first 14 and second 16 walls over the base 12 and into overlapping vertically spaced relationship to one another.

Figure 9:
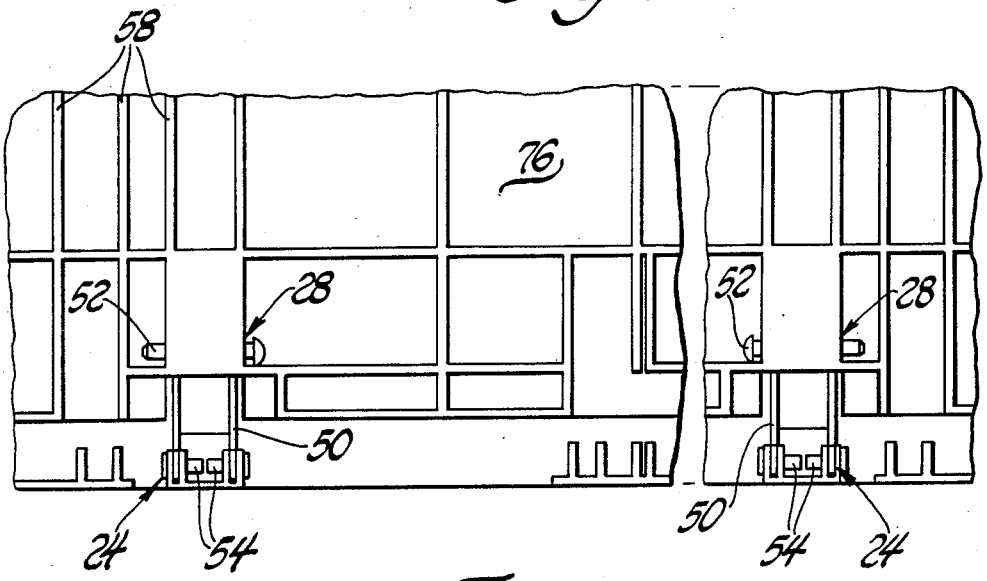
FIG. 9 is an enlarged external view of portions of a side wall, showing components of the hinge means.

Interlocking means, generally indicated at 26 (shown in greater detail in FIGS. 6 and 7), releasably interconnect the side edge of each side wall 14, 16, 18, 20 to the side edge of the adjacent side wall 28 in the vertical position. The hinge means 24 include lost motion means, generally indicated at 28 (shown in FIG. 9), for allowing the side walls 14, 16 to mvoe vertically relative to the base for locking and unlocking the interlocking means 26. The third and fourth side walls 18, 20 need not be moved vertically for interlocking.

As set forth above, the hinge means 24 for the first 14 and second 16 walls lie in vertically spaced horizontal planes, whereas the hinge means 24 for the third 18 and fourth 20 of the side walls are in the same horizontal plane above the horizontal plane for the hinge means 24 for the second side wall 18. The third and forth side walls 18, 20 extend from their associated hinge means 24 to the tops 22 thereof a distance less than one-half the distance between the hinge means 24 for the third and fourth side walls 18, 20. That is to say, the opposing side walls 18 and 20 do not overlap when folded downward, instead lying flat on top of the folded walls 14 and 16.

Figure 6:
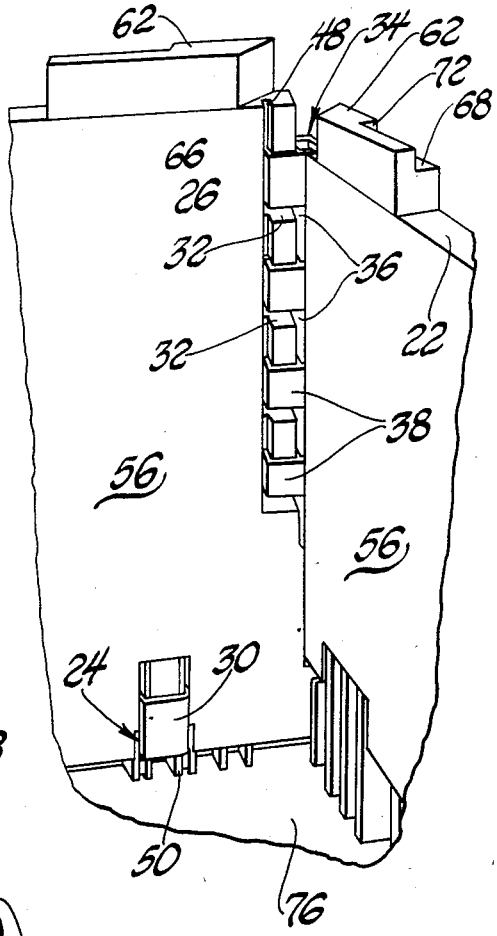
FIG. 6 is an enlarged perspective view of the interlocking means, showing the lugs in the lug-receiving openings.
Figure 7:
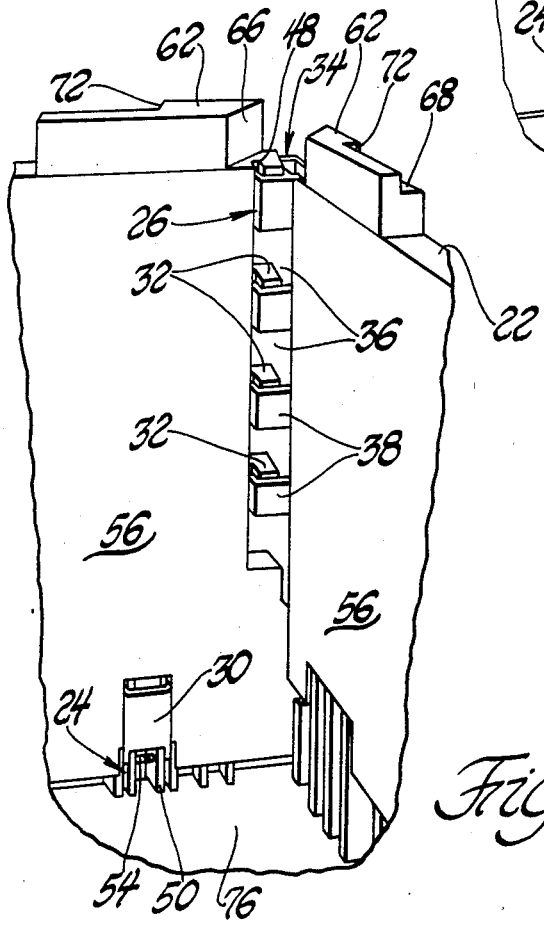
FIG. 7 is an enlarged perspective view of the interlocking means showing the lugs being moved into the retaining pockets.
Figure 8:
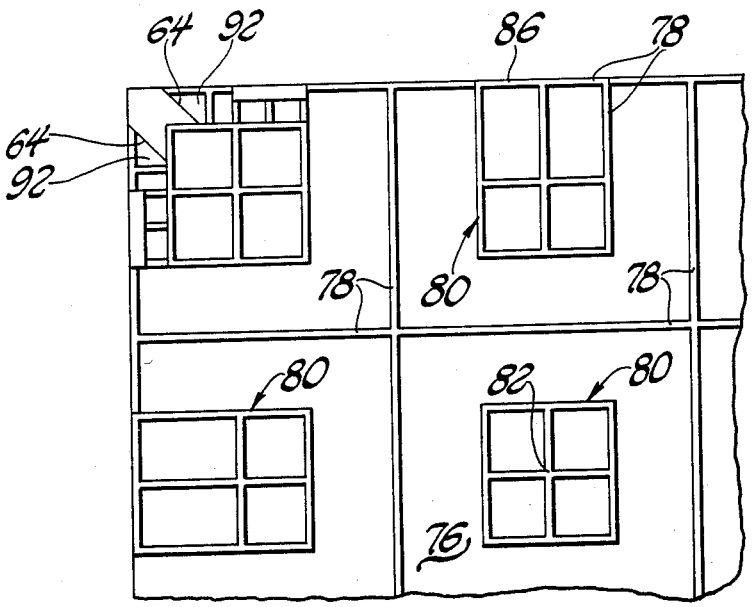
FIG. 8 is an external view of the underside of the base for stacking the container.

Vertical or lost motion is illustrated by the changed positions of the side wall and plate 30 relative to the base 12 as shown by FIGS. 6 and 7.

Figure 5:
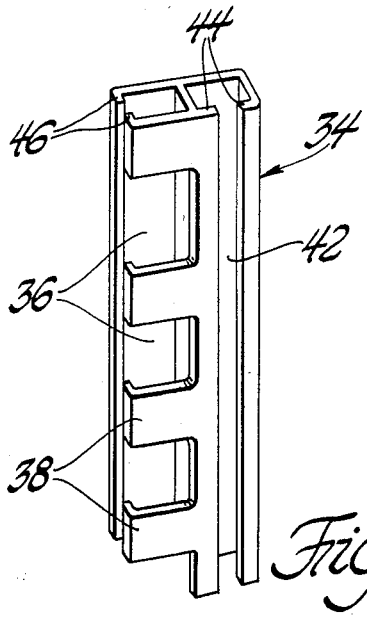
FIG. 5 is a perspective view of the independent channel member detached from the side wall of the container.

With reference to FIGS. 5, 6 and 7, the interlocking means 26 includes a plurality of vertically spaced lugs 32 disposed along one edge of one side wall 14, 16, 18, 20 and a lug-retainer means, generally indicated at 34, disposed along the adjacent edge of the adjacent side wall. The lug retainer means 34 has lug-receiving openings 36 alternately disposed among lug-retaining pockets 38. In operation the side wall is vertically raised to align the lugs 32 thereof with the lug-receiving openings 38 of the adjacent side wall; the lugs 32 are then moved into the lug-receiving openings 36 and then the lugs 32 are moved vertically downward into the lug-retaining pockets 38 as the side wall is moved vertically downward. Preferably, the first and second opposing side walls 14, 16 each have the lugs 32 along opposite edges thereof and the other opposing side walls 18, 20 have retaining pockets 40 along the edges thereof.

With particular reference to FIG. 5, the lug retainer means 34 is preferably defined by an independent channel member having a longitudinal slotted portion 42 for slidable installation downwardly and preferably onto an edge of one of the side walls 18, 20. The slot 42 in the channel member is defined by flanges 44 which slide downwardly within a pair of complementary longitudinal grooves in the edge of the third and fourth side walls 18, 20. Similarly, the retaining pockets 38 have flanges 46 which are received within a pair of grooves 48 along an edge of the side walls 14, 16.

Again with reference to FIGS. 1 and 2 and the above accompanying descriptions, the lost motion means 28 includes at least one link 50 having longitudinal slots (not shown) therein for receiving a pin 52 to allow vertical motion of the pin 52 within the slots and of the associated side wall relative to the base 12. The hinge means 24 for each side wall further includes pins 54 which pivotally connect each of said side walls 14, 16, 18, 20 to at least one side of the base 12.

The side walls 14, 16, 18, 20 have planar interior sheets 56 with ribs 58 extending outwardly therefrom for strength and support. Both the base 12 and side walls 14, 16, 18, 20 are made of respective integral pieces of plastic.

With respect to the stackable feature of the subject container assembly, the base 12 includes leg 60 extending downwardly from each intersection of two sides. Each of the side walls 14, 16, 18, 20 has a projection 62 extending upwardly from the top 22 thereof adjacent each side edge thereof. The projections 62 of adjacent side walls 14, 16, 18, 20 coact together in the vertical position to receive and engage the legs 60 in stacking one assembly upon another.

Each of the legs 60 includes square exterior side surfaces and parallel interior surfaces 64 extending diagonally inwardly from said exterior side surfaces. Each of the projections 62 presents a diagonally extending surface 66 for abutting one of the diagonal interior surfaces 64 and includes a step 68 in the exterior thereof. The base 12 includes alignment pegs 70 extending downwardly therefrom and engaging the steps 68 for stacking the assemblies 10 with the side walls in a vertical position. Each of the steps has an end 72 for engaging the side 74 of one of said pegs 70 for horizontal interfacing between said pegs 70 and said projections 62.

The base 12 includes a planar support 76 and ribs 78 extending downwardly therefrom. The ribs 78 extend transversely to one another and define a plurality of four-sided enclosures, generally indicated at 80, with the ribs 78 being disposed in symmetrical patterns in the four quadrants about the center 82 of the base 12.

A first pair of stops 88 extend vertically upward from the hinge means 24 for each of the third and fourth side walls 18, 20 for arrestably limiting the pivotal movement of said third and fourth side walls 18, 20 at the vertical position. This prevents the side walls 18, 20 from being unfolded past the vertical position. Each of the first stops 88 presents a horizontal peg support surface 90 abutting the bottom of one of the alignment pegs 70 for vertically stacking the containers 10 upon one another. Thus, when the container is folded (empty) another container 10 may be positioned for stacking thereupon by means of the alignment pegs 70 coacting with the abutment surfaces 90.

A base support member 86 extends downwardly from each lateral side of the planar support 76 and perpendicularly inwardly toward the center of the base 12. Each of the base support members 86 defines a pair of forked channels 88 extending perpendicularly inwardly from each side of said base for receiving fork lifts for mechanically raising and lowering the container 10.

A second pair of stops 90 each extend upwardly from opposing lateral sides of the base 12 externally of the first and second side walls 14, 16 for arrestably limiting the pivotal motion of said first and second side walls 14, 16 at the vertical position when the container is being unfolded.

The parallel interior surfaces 64 of each of the legs 60 together with said side 74 of each of two adjacent pegs 70, extend downwardly from intersecting sides of said base to define a pair of recesses 92 for receiving said coacting projections 62 of adjacent side walls 14, 16, 18, 20 in the vertical position.

Accordingly, any combination of folded and unfolded containers may be stacked upon one another.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A foldable container assembly (10) comprising; a base (12) having a plurality of sides, at least one side wall (14, 16, 18, 20) extending vertically upwardly from each side of said base (12) with the tops (22) of said side walls all being aligned in a horizontal plane, and including hinge means (24) interconnecting each of said side walls (14, 16, 18, 20) to said base (12), characterized by said base (12) including legs (60) extending downwardly from each intersection of two sides thereof, each of said side walls (14, 16, 18, 20) having a projection (62) extending upwardly from the top (22) thereof adjacent each side edge thereof, said projection (62) of adjacent side walls (14, 16, 18, 20) coacting together in the vertical position to receive and engage said legs (60) in stacking one assembly upon another, each of said legs (60) including square exterior side surfaces and parallel interior surfaces (64) extending diagonally inwardly from said exterior side surfaces, each of said projections (62) presenting a diagonally extending surface (66) for abutting one of said diagonal interior surfaces (64).

2. An assembly as set forth in claim 1 wherein each of said projections (62) includes a step (68) in the exterior thereof, said base (12) including alignment pegs (70) extending downwardly for engaging said steps (68) for stacking said assemblies (10).

3. An assembly as set forth in claim 2 wherein each of said steps (68) has an end (72) for engaging the side (74) of said peg (70) for horizontal interfacing between said pegs (70) and said projections (62).

4. An assembly as set forth in claim 1 wherein said base (12) includes a planar support (76) and ribs (78) extending downwardly therefrom, said ribs (78) extending transversely to one another and defining a plurality of four-sided enclosures (80), said ribs (78) being disposed in symmetrical patterns in the four quadrants about the center (82) of said base (12).

5. An assembly as set forth in any one of claims 1, 2, 3, or 4 wherein said base (12) and said side walls (14, 16, 18, 20) are made of respective integral pieces of plastic.

6. An assembly as set forth in claim 4 including a first pair of stops (88) extending vertically upwardly from said hinge means (24) for each of said third and fourth side walls (18, 20), for arrestably limiting the pivotal motion of said third and fourth side walls (18, 20) at the vertical position.

7. An assembly as set forth in claim 6 wherein said first stops (88) each present a horizontal peg support surface (90) abutting the bottom of one of said alignment pegs (70) for vertically stacking said containers (10) upon one another.

8. An assembly as set forth in claim 4 including a base support member (86) extending downwardly from each lateral side of said planar support (76) and perpendicularly inwardly toward the center (82) of said base (12).

9. An assembly as set forth in claim 8 wherein each of said base support members (86) define a pair of forked channels (88) for receiving forked lifts for mechanically raising and lowering said container (10).

10. An assembly as set forth in claim 4 including a second pair of stops (90) each extending upwardly from opposing lateral sides of said base and externally of said first and second side walls (14, 16) for arrestably limiting the pivotal motion of said first and second side walls (14, 16) at the vertical position.

11. An assembly as set forth in claim 4 wherein said parallel interior surfaces (64) of each of said legs (60), together with said side (74) of two of said adjacent pegs (70), define a pair of generally trapezoidal recesses (92) for receiving said coacting projections (62) from said tops (22) of adjacent side walls (14, 16, 18, 20) in the vertical position.

12. An assembly as set forth in claim 1 wherein said hinge means (24) interconnects each of said side walls (14, 16, 18, 20) to said base (12) with the hinge means (24) for a first side wall (14) being in a vertically spaced horizontal plane from the hinge means (24) for a second side wall (16) for folding said first (14) and second (16) walls over said base (12) and into overlapping vertically spaced relationship to one another.

13. An assembly as set forth in claim 1 including interlocking means (26) for releasably interconnecting the side edge (28) of each side wall (14, 16, 18, 20) to the side edge (28) of the adjacent side wall when in the vertical position.

14. An assembly as set forth in claim 13 wherein said hinge means (24) includes lost motion means (28) for allowing at least two of said side walls (14, 16) to move vertically relative to said base (12) for locking and unlocking said interlocking means (26).

15. An assembly as set forth in any one of claims 1, 13 or 14 including four of said side walls with said hinge means (24) for third (18) and fourth (20) of said side walls being in the same horizontal plane above said horizontal plane for said hinge means (24) for said second (16) side wall, said third (18) and fourth (20) side walls extending from said associated hinge means (24) to said tops (22) thereof a distance less than one-half the distance between said hinge means (24) for said third (18) and fourth (20) side walls.

16. A foldable container assembly (10) comprising; a base (12) having a plurality of sides, at least one side wall (14, 16, 18, 20) extending vertically upwardly from each side of said base (12) with tops (22) of said side walls all being aligned in a horizontal plane, and including hinge means (24) interconnecting each of said side walls (14, 16, 18, 20) to said base (12) with the hinge means (24) for a first side wall (14) being in a vertically spaced horizontal plane from the hinge means (24) for a second side wall (16) for folding said first (14) and second (16) walls over said base (12) and into overlapping vertically spaced relationship to one another, interlocking means (26) for releasably interconnecting the side edge (28) of each side wall (14, 16, 18, 20) to the side edge (28) of the adjacent side wall when in the vertical position, said hinge means (24) including lost motion means (28) for allowing at least two of said side walls (14, 16) to move vertically relative to said base (12) for locking and unlocking said interlocking means (26), said interlocking means (26) includes a plurality of vertically spaced lugs (32) disposed along one edge of one side wall and a lug retainer means (34) disposed along the adjacent edge of the adjacent side wall, said lug retainer means (34) having lug-receiving openings (36) alternatively disposed among lug-retaining pockets (38) so that the one side wall may be vertically raised to align the lugs (32) thereof with the lug-receiving openings (36) of the adjacent side wall and moved thereinto and then moved vertically into the lug-retaining pockets (38) as the side wall is moved vertically downward, said lug retainer means (34) defined by an independent channel member having a longitudinal slotted portion (42) for slidable installation downwardly onto an edge of said side wall.

17. An assembly as set forth in claim 16 wherein two opposing side walls (14, 16) each have said lugs (32) along opposite edges thereof and the other opposing walls (18, 20) have the retaining pockets (40) along the edges thereof.

18. An assembly as set forth in claim 16 wherein said lost motion means (30) includes at least one link (50) having slots therein for receiving a pin (54) to allow vertical motion of the associated side wall relative to said base (12).

19. An assembly as set forth in claim 18 wherein said side walls (14, 16, 18, 20) each have planar interior sheets (56) with ribs (57) extending outwardly therefrom 20. A foldable container assembly (10) comprising; a base (12) having a plurality of sides, at least one side wall (14, 16, 18, 20) extending vertically upwardly from each side of said base (12) with the tops (22) of said side walls all being aligned in a horizontal plane, and including hinge means (24) interconnecting each of said side walls (14, 16, 18, 20) to said base (12) with the hinge means (24) for a first side wall (14) being in a vertically spaced horizontal plane from the hinge means (24) for a second side wall (16) for folding said first (14) and second (16) walls over said base (12) and into overlapping vertically spaced relationship to one another, including interlocking means (26) for releasably interconnecting the side edge (28) of each side wall (14, 16, 18, 20) to the side edge (28) of the adjacent side wall when in the vertical position, said hinge means (24) including lost motion means (28) for allowing at least two of said side walls (14, 16) to move vertically relative to said base (12) for locking and unlocking said interlocking means (26), said base (12) including legs (60) extending downwardly from each intersection of two sides thereof, each of said side walls (14, 16, 18, 20) having a projection (62) extending upwardly from the top (22) thereof adjacent each side edge thereof, said projections (62) of adjacent side walls (14, 16, 18, 20) coacting together in the vertical position to receive and engage said legs (60) in stacking one assembly upon another, each of said legs (60) including square exterior side surfaces and parallel interior surfaces (64) extending diagonally inwardly from said exterior side surfaces, each of said projections (62) presenting a diagonally extending surface (66) for abutting one of said diagonal interior surfaces (64), each of said projections (62) including a step (68) in the exterior thereof, said base (12) including alignment pegs (70) extending downwardly for engaging said steps (68) for stacking said assemblies (10).

21. An assembly as set forth in claim 20 wherein each of said steps (68) has an end (72) for engaging the side (74) of said peg (70) for horizontal interfacing between said pegs (70) and said projections (62).

* * * * *